United States Patent [19]

Higgins

[11] Patent Number: 4,509,992

[45] Date of Patent: Apr. 9, 1985

[54] PROCESSES AND COMPOSITIONS FOR THE TREATMENT OF ALUMINUM SURFACES

[75] Inventor: George L. Higgins, Windsor, England

[73] Assignee: Parker Chemical Company, Madison Heights, Mich.

[21] Appl. No.: 518,508

[22] Filed: Jul. 29, 1983

Related U.S. Application Data

[62] Division of Ser. No. 339,958, Jan. 18, 1982, abandoned.

[51] Int. Cl.[3] ..... C23F 7/06

[52] U.S. Cl. ..... 148/6.27

[58] Field of Search ..... 148/6.27

[56] References Cited

U.S. PATENT DOCUMENTS

| | | | |
|---|---|---|---|
| 2,924,539 | 2/1960 | Arndt | 148/6.27 |
| 3,284,202 | 11/1966 | Leonard | 148/6.16 |
| 3,376,143 | 4/1968 | Barkman | 148/6.27 |

FOREIGN PATENT DOCUMENTS

| | | | |
|---|---|---|---|
| 2461764 | 3/1981 | France | 148/6.27 |
| 6344 | 1/1977 | Japan | 148/6.27 |

*Primary Examiner*—Sam Silverberg

*Attorney, Agent, or Firm*—Arthur E. Kluegel

[57] ABSTRACT

A composition for forming paint-base coatings on aluminum comprising an aqueous solution having a pH of from about 9 to about 12.5 and containing an effective coating forming amount of a complexing agent which has at least one of a nitrogen atom with a lone pair of electrons and a carboxylate group, which solution is substantially free of components which inhibit the coating formation. Aluminum surfaces are treated with the this solution to form a paint-base coating having a thickness of at least about 0.05 g/m$^2$ and, thereafter, a paint or similar siccative coating is applied to the surface without the prior application of chromate or other conventional paint-base coating forming materials.

6 Claims, No Drawings

PROCESSES AND COMPOSITIONS FOR THE TREATMENT OF ALUMINUM SURFACES

This is a division of co-pending application 339,958, filed Jan. 18, 1982 now abandoned.

This inventon relates to the treatment of aluminum surfaces, and more particularly relates to the treatment of surfaces consisting of aluminum or of alloys formed mainly of aluminum and which thus can be treated in a similar manner to aluminum to form paint-base coatings thereon.

BACKGROUND OF THE INVENTION

It is will known to clean aluminum surfaces by contact with aqueous alkaline cleaning solutions. If the solution is free of ingredients that will inhibit alkaline attack on aluminum the pH of the cleaners is generally from 9 to 10, while if the solution contains ingredients that will inhibit alkaline attack of aluminum the pH may be 12 or 13. Examples of materials that will inhibit alkaline attack on aluminum are sodium phosphate and sodium silicate. It is known to include complexing agents or similar materials in alkaline cleaners.

It is often necessary to form a coating on a clean aluminum surface, for instance that has been cleaned by treatment with one of these cleaners, and traditional coating compositons for aluminum include solutions containing hexavalent chromium and fluoride, usually with additions of accelerators such as ferricyanides or molybdates. Although these solutions form coatings which provide a good base for paint they do suffer from severe environmental problems in that both fluoride and hexavalent chromium are undesirable on health and safety grounds. For instance effluent containing hexavalent chromium must be treated before discharge. The solutions are acidic and so the apparatus by which they are applied must be resistant both to acid and fluoride.

Alkaline processes for forming coatings are known but they involve the application of hot solutions containing hexavalent chromium and so still present environmental problems.

More recently processes for forming coatings without hexavalent chromium have been developed. These therefore avoid the toxic hazards of hexavalent chromium but they are generally still acidic and still contain fluorides and so still create environmental problems and the need for apparatus which is resistant to acid and fluoride. Such solutions contain, for instance, tannin, titanium or zirconium, and fluoride.

It is, therefore, an object of the present invention to provide a process for forming a coating on aluminum that is a satisfactory base for paint and which does not involve the disadvantages of the use of hexavalent chromium, fluoride, or acidic solutions.

This and other objects will become apparent to those skilled in the art from the description of the invention which follows.

SUMMARY OF THE INVENTION

It has now been found that a coating on which paint may be applied without intervening chemical treatment can be formed on an aluminum surface by contacting the surface with an aqueous solution that is substantially free of inhibiting ingredients and that has a pH of between about 9 and about 12.5 and that contains a dissolved complexing agent that has a nitrogen atom with a lone pair of electrons or a carboxylate group or both.

The invention includes the process of forming the coating, solutions by which the coating can be formed, and a process in which the coating is formed, is optionally rinsed and dried, and a paint coating is then formed on it, without any intervening chromate or other coating step.

DETAILED DESCRIPTION OF THE INVENTION

Most aqueous alkaline cleaning solutions simply clean the aluminum, but it was observed that a slight colored film is formed when some particular solutions are applied under unusual conditions, for instance when they contain a particular type of complexing agent and are applied much hotter than usual. Initially, it was believed this film was undesirable or, at best, unimportant. It was found however, that this film did not interfere with the subsequent conventional coating formation steps, such as treatment with hexavalent chromium and fluoride and so presumably the colored film formed by the cleaner was destroyed during the formation of the coating that was to serve as the base for paint. It was subsequently discovered that this film could be increased and improved so as to form a thicker coating and that could be used, alone, as the base for paint. As a result of this, it is now possible to form on aluminum a coating that will serve as a good base for paint, without having to use acidic solutions, fluoride solutions or chromate solutions.

The coating that is formed is preferably thicker than any of the films observed in the work using cleaners, even under unusual conditions. These films had immeasurably low weights but in the practice of the present invention, the coating weight is typically at least 0.05 $g/m^2$, and preferably 0.1 to 1.0 $g/m^2$.

The solution used to form this coating must contain a dissolved complexing agent that has at least one nitrogen atom with a lone pair of electrons or at least one carboxylate group or both. Such compounds include, for instance, ethylene diamine, ammonia, urea, acetic acid, citric acid, oxalic acid and their alkali metal or other water soluble derivatives. Preferably, the complexing agent used in the present invention contains both at least one nitrogen atom with a lone pair of electrons and at least one carboxylate group. Preferred complexing agents are amino carboxylic acids such as alanine, glycine, ethylenediamine tetraacetic acid (EDTA) and nitrilotriacetic acid (NTA) as well as their alkali metal salts or other water soluble derivatives.

The amount of complexing agent used is generally between 0.5 and 20 g/l. When the complexing agent is an amino carboxylic acid the amount, measured as the sodium salt, is preferably from 1 to 10 g/l. If the amounts are too low satisfactory coating formation does not occur and increasing the amount beyond the upper limits proposed does not give any advantage.

The pH of the solution must be between 9 and 12.5. If it is below 9 satisfactory coatings are not formed and if it is above 12.5 there is increased tendency to etch the metal. Generally the pH is between 9.5 and 12, most preferably 10 to 11.5. The pH is achieved by including in the solution a sufficient amount of an appropriate alkaline compound. This compound must not be one that will result in inhibition of the attack of the solution on the aluminum and thus many of the alkaline compounds often used in cleaners, such as sodium phosphate or sodium silicate, cannot be used for the pH adjustment. pH adjustment is preferably achieved using sodium hydroxide as the alkaline material but other alkaline materials that do not introduce inhibiting ions can be used, such as sodium carbonate or ammonium hydroxide. Generally the alkaline material is one that introduces only ions that are present in any event in the tap water from which the solution may be prepared.

As mentioned, the solution must be free of inhibitors such as sodium phosphate or sodium silicate, as well as other inhibitors such as quaternary ammonium salt surfactants. Additionally, the solution should be free of fluorides, chromium compounds or any of the other coating ingredients that are conventionally used when forming coatings on metal, including phosphates. Preferably, the solution consists solely of water, the complexing agent, and alkali for pH adjustment. Optionally, non-inhibiting surfactants and/or oxidizing agents may be included. The inclusion of one or more sufactant is sometimes desirable and in particular may cause the color of the coating to be deeper. The preferred surfactants are betaines, but non-inhibiting, non-ionic or anionic surfactants may also be used. Cationic surfactants are generally inhibiting, and thus, are not suitable.

It is particularly preferred also to include an oxidizing agent in the composition. Without an appropriate oxidizing agent, the coating formation is slow and may require contact between the solution and the metal surface for extended times, typically four hours to eight hours or more. However with an appropriate oxidizing agent good coating formation can be achieved much more quickly, generally less than two hours. The oxidizing agent that is in the solution is preferably a per-salt oxidizing agent and this may be introduced into the solution by adding hydrogen peroxide, a water soluble per-salt, such as sodium persulphate, or some other compound that will release peroxide in solution, such as a perborate. Compounds such as persulphates are preferably introduced as the alkali metal or ammonium persulphate. Other oxidizing agents, such as nitrites, nitrates and chlorates, have not been found to be as effective as per-salt oxidizing agents and, thus, are not preferred.

The amount of oxidizing agent depends upon the particular material being used. If it is too low the processing time necessary to achieve a good coating will not be reduced adequately below the four hours or more necessary in the absence of oxidizing agent. If it is too high the solution may become unstable. Generally the amount is such that adequate coatings are achieved in less than two hours. When the oxidizing agent is introduced as a persulphate the amount should be from 1 to 50 g/l, measured as sodium persulphate most preferably 3 to 20 g/l. Similar amounts of peroxide, measured as sodium peroxide, may be used. When the oxidizing agent is hydrogen peroxide the amount is preferably similar measured as "100 volume" hydrogen peroxide.

The temperature of the solution during contact between the solution and the metal surface is generally between ambient and about 50° C., preferably about 25° to 45° C. Temperatures below ambient (e.g. below about 20° C.) result in slow coating formation, while temperatures above 50° C. lead to increased instability of the solution.

Contact between the solution and the surface can be achieved in any convenient manner, for instance by immersion or spray and is conducted for the duration necessary to achieve the desired coating. It is always less than 24 hours and is generally less than 2 hours. Generally, the contact has to be at least one minute and preferably is about two to thirty minutes.

After the formation of a coating it is generally well rinsed with water and may then be dried. A paint or lacquer or other siccative coating may then be applied in conventional manner without the prior application of any chromate or other coating treatment.

In order that those skilled in the art may better understand the present invention, the following specific examples are given.

EXAMPLE 1

A solution was prepared by dissolving in tap water, 2 g/l trisodium NTA, 10 g/l sodium persulphate and sufficient sodium hydroxide to bring the pH to 11. The solution was brought to a temperature of 35° C. and a cleaned panel of S1C grade aluminum was immersed in the solution for 15 minutes. A brown coating was formed. The panel was then rinsed with water and dried and then painted with a stoving acrylic paint. The resultant paint coating was subjected to an acetic acid accelerated salt spray test according to ASTM B287 specification with cross scoring. After 500 hours the panel was removed and the score taped. No paint removal occurred, thus showing that the coating was a very satisfactory base for paint.

EXAMPLE 2

The procedure of Example 1 was repeated except that the sodium persulphate was replaced with potasium persulphate and similar results were obtained when the coated panel was subjected to the salt spray test.

EXAMPLE 3

The procedure of Example 1 was repeated except that sodium persulphate was replaced with ammonium persulphate. The coating formed was blue to purple in color and was iridescent. Similar results were obtained when the coated panel was subjected to the salt spray test.

EXAMPLE 4

The procedure of Example 1 was repeated except that 8 g/l trisodium NTA and 40 g/l sodium persulphate were used. The coating formed was heavier than in Example 1 and was less colored and iridescent. When the coated panel was subjected to the salt spray test, similar results were obtained.

The procedure of the preceding Examples is repeated using ethylene diamine, urea, acetic acid, citric acid, oxalic acid, alanine, glycine and EDTA, as the complexing agent; ammonium perborate, sodium peroxide, and hydrogen peroxide, as the oxidizing agent; and sodium carbonate and ammonium hydroxide to adjust the pH within the range of 9 to 12.5. In each instance, similar results are obtained.

What is claimed is:

1. A process for coating aluminum which comprises contacting an aluminum surface with a composition which comrpises an aqueous solution having a pH of from about 9 to about 12.5 and containing an effective coating forming amount of a complexing agent which has at least one of a nitrogen atom with a lone pair of electrons and a carboxylate group, and an oxidizing agent which solution is substantially free of components which inhibit the coating formation, to form a paint-base coating on such surface having a thickness of at least about 0.5 g/m$^2$ and, thereafter, applying a siccative coating to the thus-formed paint-base coating.

2. The process as claimed in claim 1 wherein the complexing agent is an amino carboxylic acid or the water-soluble salt thereof.

3. The process as claimed in claim 1 wherein the oxidizing agent is a per-salt.

4. The process as claimed in claim 2 wherein the pH of the solution is adjusted to within the desired range by the addition of sodium hydroxide.

5. The process as claimed in claim 2 wherein the complexing agent is present in an amount within the range of 0.5 to 20 g/l and the oxidizing agent is present in an amount within the range of about 1 to 50 g/l.

6. The process as claimed in claim 5 wherein the complexing agent is the trisodium salt of nitrilotriacetic acid and the oxidizing agent is sodium persulphate.

* * * * *